US006138821A

United States Patent [19]

Hsu

[11] Patent Number: 6,138,821

[45] Date of Patent: Oct. 31, 2000

[54] CONTAINER DEVICE FOR SEPARATELY ENCLOSING TWO DIFFERENT SUBSTANCES

[76] Inventor: Lily Hsu, 5Fl., No. 8, Alley 5, Lane 217, Sec. 3, Chunghsiao East Road, Taipei, Taiwan

[21] Appl. No.: 09/451,086

[22] Filed: Nov. 30, 1999

[51] Int. Cl.[7] ..... B65D 81/32

[52] U.S. Cl. ..... 206/222; 215/DIG. 8

[58] Field of Search ..... 206/219–222, 206/568; 215/DIG. 8; 222/80

[56] References Cited

U.S. PATENT DOCUMENTS

| | | | |
|---|---|---|---|
| 3,603,469 | 9/1971 | Magni | 206/222 |
| 3,802,604 | 4/1974 | Morane et al. | 206/222 |
| 4,024,952 | 5/1977 | Leitz | 215/DIG. 8 |
| 4,610,374 | 9/1986 | Buehler | 206/222 |
| 4,682,689 | 7/1987 | Pereira et al. | 206/222 |
| 4,693,366 | 9/1987 | Gonclaves | 206/222 |
| 4,715,916 | 12/1987 | Gonclaves | 206/222 |
| 5,353,928 | 10/1994 | Schumacher | 206/222 |
| 5,388,690 | 2/1995 | Mutterle et al. | 206/222 |
| 5,710,888 | 1/1998 | Gonclaves | 206/222 |
| 5,893,573 | 11/1998 | Morini | 215/DIG. 8 |
| 5,927,549 | 7/1999 | Wood | 206/222 |

*Primary Examiner*—Jim Foster
*Attorney, Agent, or Firm*—Shoemaker and Mattare

[57] ABSTRACT

A container device for separately enclosing two different substances is provided. A cap member having an air-tight closure assembly is received therein for air-tightly encapsulating a second substance removably mounted to a body. The body is integrally formed with a neck on which the cap member is removably mounted and has storage space for receiving a first substance. In order to prevent the first substance from leaking out of the body, the air-tight closure assembly is adapted to be compatible with the neck of the body which allows the storage space to be sealed air-tightly to prevent leakage. To release the second substance from the air-tight closure assembly, a cutting member is provided to cut open the air-tight closure assembly, which is accomplished by downwardly moving the cap member to bring the air-tight closure assembly to be in contact with the cutting member.

20 Claims, 8 Drawing Sheets

CONTAINER DEVICE FOR SEPARATELY ENCLOSING TWO DIFFERENT SUBSTANCES

BACKGROUND OF THE INVENTION

1. Field of the Invention

This invention relates to container devices, and more particularly, to a container device having a body for enclosing one substance and a cap for closing an opening of the body so as to keep the other substance enclosed within the cap separate from the substance enclosed by the body.

2. Description of Related Art

There has been a tendency for a beverage or a soft drink to come with a liquid solvent that is separate from a solute, which is usually in a form of tablet. This tablet is dissolved or mixed with the liquid solvent to become a drinkable solution at the time a person is to consume the drinkable solution. The reason why the solute is kept separate from the liquid solvent is such a drinkable solution is inappropriate for storage or to be in a ready-to-drink status and the solute is unstable with respect to the environment, such as moisture and air. Therefore, the solute should be sealed air-tight inside an enclosure prior to being dissolved in or mixed with the liquid solvent.

There are two types of conventional container devices, which provide the solute with a protective enclosure. One typically consists of a main container for retaining a liquid solvent and an annex container for retaining a solute. This type of container device requires a person to in turn open the main container and the annex container or vice versa in order to have the solute contact with the liquid solvent and thereby to become a drinkable solution. However, the problem is that two independent opening operations are necessary for making the aforementioned drinkable solution, causing this conventional container device to be inconvenient and complicated in operation.

Another type of conventional container devices is one including a container body having an opening for a plug assembly closably inserted thereinto and a storage space defined by the container body for retaining a liquid solvent. The plug assembly consists of a plug body having a guide sleeve, the guide sleeve having an upper end integral with the plug body and a lower end covered by a sealing member for retaining a solute inside the guide sleeve; and a tabular cutting member slidably plugged into the guide sleeve via the upper end of the guide sleeve. The tabular cutting member is capable of air-tight sealing the guide sleeve so as to prevent the solute received in the guide sleeve from being in contact with the ambient. In use, a user has to first remove from the container body a protection cover used to protect the tabular cutting member from being compressed prior to use, and then press down the tabular cutting member to separate the sealing member from the lower end of the guide sleeve in order to release the solute from the guide sleeve and to allow the solute to resolve in or mix with the liquid solvent in the container body. After this, the plug assembly is removed away from the container body for the user to consume the thus-obtained solution. Accordingly, the problem which comes with this type of container device is that it requires three steps to make available a solution ready for consumption. It is therefore laborious and inconvenient in operation.

SUMMARY OF THE INVENTION

It is the objective of the present invention to provide a container device which is simpler and easier in operation than the prior art, allowing a second substance received in a cap member, originally separate from a first substance enclosed in a body cooperative with the cap member, to be in contact with the first substance and which is reliable in preserving the quality of the second substance as well as that of the first substance.

In accordance with the foregoing objective, the container device of the present invention includes a hollow body having a neck integral therewith, the neck being formed with an opening penetrating through the neck to connect a storage space defined by the body for a first substance to be retained therein, and the neck being formed with an annular rib on its outer surface; a cap member reclosably coupled to the neck of the body for air-tightly closing the opening; an air-tight closure assembly received from inside the cap member for encapsulating a second substance and being synchronously movable with the cap member at the time the cap member is driven by a manual force to move in an axial manner along the neck of the body; a cutting means adapted for releasing the second substance from the air-tight closure assembly; and a collar detachably attached to a bottom of the cap member, allowing the cap member to be driven from an upper position where the air-tight closure assembly remains at a distance from the cutting means to a lower position where the bottom of the cap member abuts against the annular rib to thereby cause the air-tight manner of the air-tight closure assembly to be released by the cutting means, after the collar is detached from the cap member.

In one embodiment according to the invention, the air-tight closure assembly is formed by a sealing film circumferentially adhered to the inner surface of a side wall of the cap member, the inner surface of the side wall of the cap member, and the inner surface of a base wall attached to the side wall of the cap member. The second substance is thus capable of being encapsulated by the air-tight closure assembly and being isolated from the external environment. The air-tight closure structure should further cooperate with at least an annular protrusion upwardly protruded from the top surface of the neck in order to tightly seal the opening of the body to prevent leakage. The annular protrusion is adapted to abut against and upwardly push the sealing film of the air-tight closure structure in such a manner that the sealing film is deformed from a planar shape to a convex shape, after the cap member is mounted on the neck of the body to a position that the collar attached to the bottom of the cap member abuts against the annular rib, allowing the first substance encapsulated in the body to be prevented from leaking.

In another embodiment according to the embodiment, the air-tight closure assembly comprises an inner housing having a downward-facing opening, a sealing film for an air-tight sealing of the downward-facing opening, and a closed space defined by the inner wall of the inner housing and the sealing film for receiving a second substance. The second substance can be placed in the inner housing and then the downward-facing opening is sealed with the sealing film, followed by installing the air-tight closure assembly of this embodiment inside the cap member by way of a conventional bonding method, ultrasonic melting method, engaging method or the like so as to have the air-tight closure assembly securely coupled to the cap member. Therefore, when the cap member is mounted on the neck of the body to a position that the collar of the cap member abuts against the annular rib, the annular protrusion on the top surface of the neck will upwardly push and tightly abut against the sealing film of the air-tight closure assembly so that the opening of the body is sealed air-tight to prevent leakage.

In a further embodiment according to the invention, the inner housing of the air-tight enclosure assembly is formed by a flexible annular body, which is outwardly curved and has a top end and a lower end, and a base substrate connected to the top end of the flexible annular body for closing the top end. The lower end of the flexible annular body is sealed by the sealing film for receiving a second substance within the closed space defined by the base substrate, flexible annular body and sealing film. As the cap member installed with the air-tight enclosure assembly is mounted to the neck of the body, the air-tight enclosure structure will partly be inserted into the opening of the body, making the flexible annular body be inwardly compressed by the neck of the body so as to seal air-tight the opening of the body to prevent leakage.

The aforementioned first substance and second substance can be in a gas, liquid or solid form. Therefore, the first substance is capable of being chemically reacted with or physically resolved in or mixed with the second substance.

These and other features, and advantages, will be more clearly understood from the following detailed description taken in conjunction with the accompanying drawings. It is important to point out that the illustrations may not necessarily be drawn to scale, and that there may be other embodiments of the present invention which are not specifically illustrated.

DETAILED DESCRIPTION OF THE PREFERRED EMBODIMENT

Figure 1:
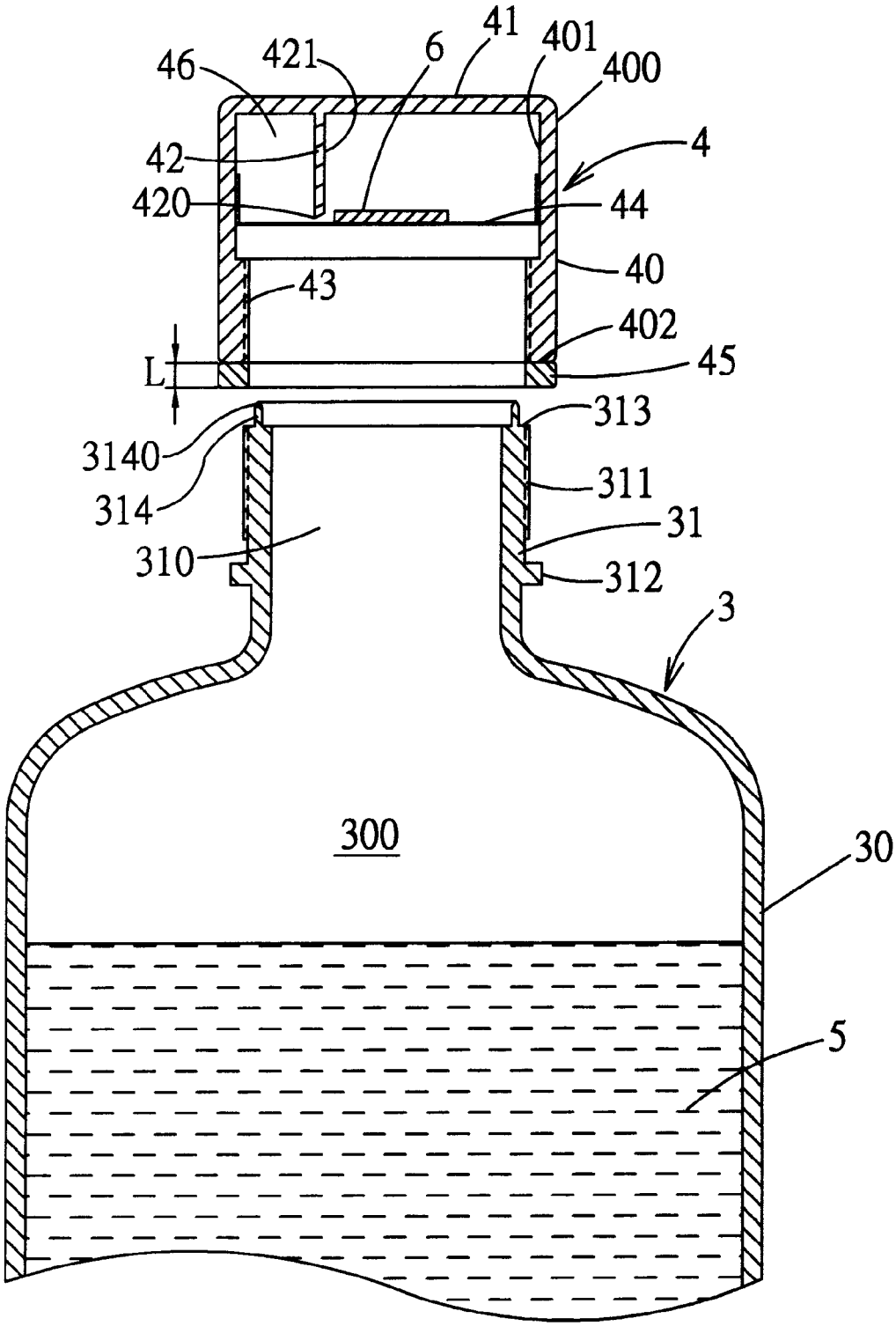
FIG. 1 is a schematic sectional view of a container device in accordance with the first embodiment of the present invention, showing that the cap is separable from the body.
Figure 2:
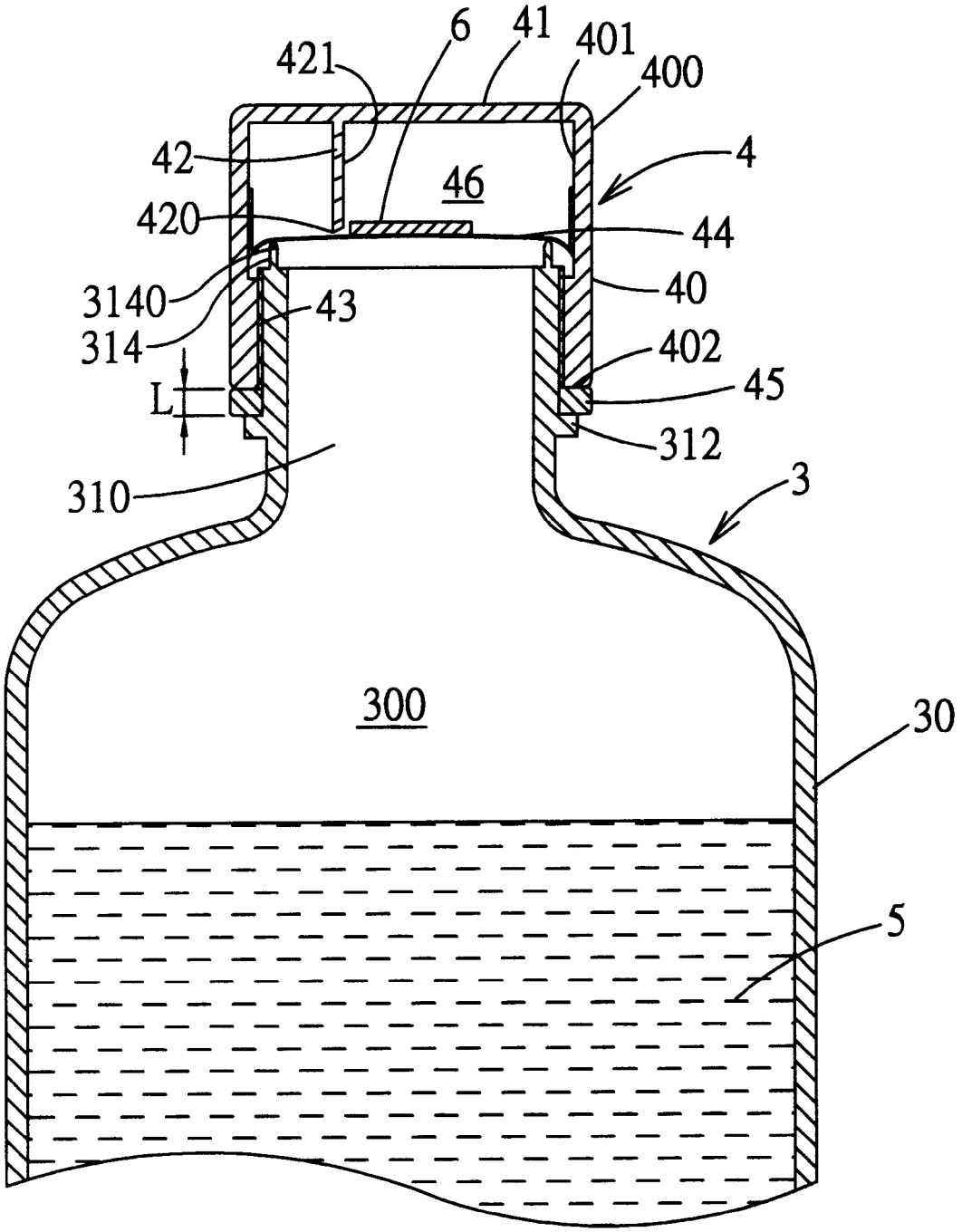
FIG. 2 is a schematic sectional view of the container device illustrated in FIG. 1 with the cap mounted to the body.

Referring to the drawings most particularly FIGS. 1 and 2, a container device is illustrated according to the first embodiment of the present invention, and is seen to generally include a body 3 and a cap 4 for being removably mounted to the body 3.

The body 3 is typically in a cylindrical shape and is integrally formed with a neck 31 on its top. The neck 31 has an outer surface threaded to form a first threaded portion 311 and an inner surface opposing the outer surface defining a through opening 310 which connects a storage space 300 defined by an inner wall of the body 3 for receiving a liquid solvent 5. Beneath the first threaded portion 311 an annular rib 312 is further integrally provided on the outer surface of the neck 31. Also, on the top surface 313 of the neck 31 there is upwardly projected an annular protrusion 314. The annular protrusion 314 may be singly or concentrically multiply formed on the top surface 313 and may be in a simple circular shape, a wave-like circular shape, or the like.

The cap 4 has an annular body 40 with an the upper surface 400, a lower surface 402 opposing the upper surface 400, and an inner surface 401. A lid 41 is attached to the upper surface 400 of the annular body 40 in order to close one end of the annular body 40 which is coupled with a cutting member 42 on its bottom surface extending toward the lower surface 402 of the annular body 40. On the inner surface 401 of the annular body 40 a second threaded portion 43 is formed to engage the first threaded portion 311 so as to securely mount the threadable cap 4 to the neck 31 of the body 3. A sealing film 44 made of a conventional flexible and extendible material, such as aluminum alloy, is provided so as to make a circumferential attachment to the inner surface 401 of the annular body 40 above the second threaded portion 43, allowing the sealing film 44, the inner surface 401 and the bottom surface of the lid 41 in combination to form an air-tight closure assembly to provide an air-tight room 46 for air-tightly encapsulating a solute 6 therein and for preventing external contaminants such as moisture or air from entering. In addition, a collar 45 is detachably coupled to both the lower surface 402 of the annular body 40 and the annular rib 312 of the neck 31 after the cap 4 is mounted to the body 3. The collar 45 is adapted to have a thickness L to allow the tip 420 of the cutting member 42 to remain separable from the sealing film 44, while the cap 4 is securably mounted to the body 3 by means of the collar 45 to allow the cap 4 to have a maximum turning of less than 360 degrees so as to prevent the sealing film 44 from being cut off from the annular body 40 by the cutting member 42, subsequent to the removal of the collar 45 from the cap 4. A more detailed description as to the relationship between the cap 4 and the body 3 will be given below.

As clearly shown in FIG. 2, the sealing film 44 is upwardly pressed by the annular protrusion 314 on the neck 31 of the body 3 to be deformed from a planar shape to a convex shape, while the threadable cap 4 is mounted to the neck 31 of the body 3 and is securable coupled to the annular rib 312 of the neck 31 by means of the collar 45. By this arrangement, the opening 310 of the neck 31 is liquid-tight, sealed by the sealing film 44, allowing the liquid solvent 5 received in the storage space 300 of the body 3 to prevent leakage through the opening 310 to the outside of the body 3. In the meantime, the tip 420 of the cutting member 42 is kept an appropriate distance from the sealing film 44, assuring that the solute 6 is encapsulated air-tight in the enclosed room 46. Also, the cap 4 is restrained from being turned downwardly toward the annular rib 312, if the collar 45 is held in position.

Figure 3:
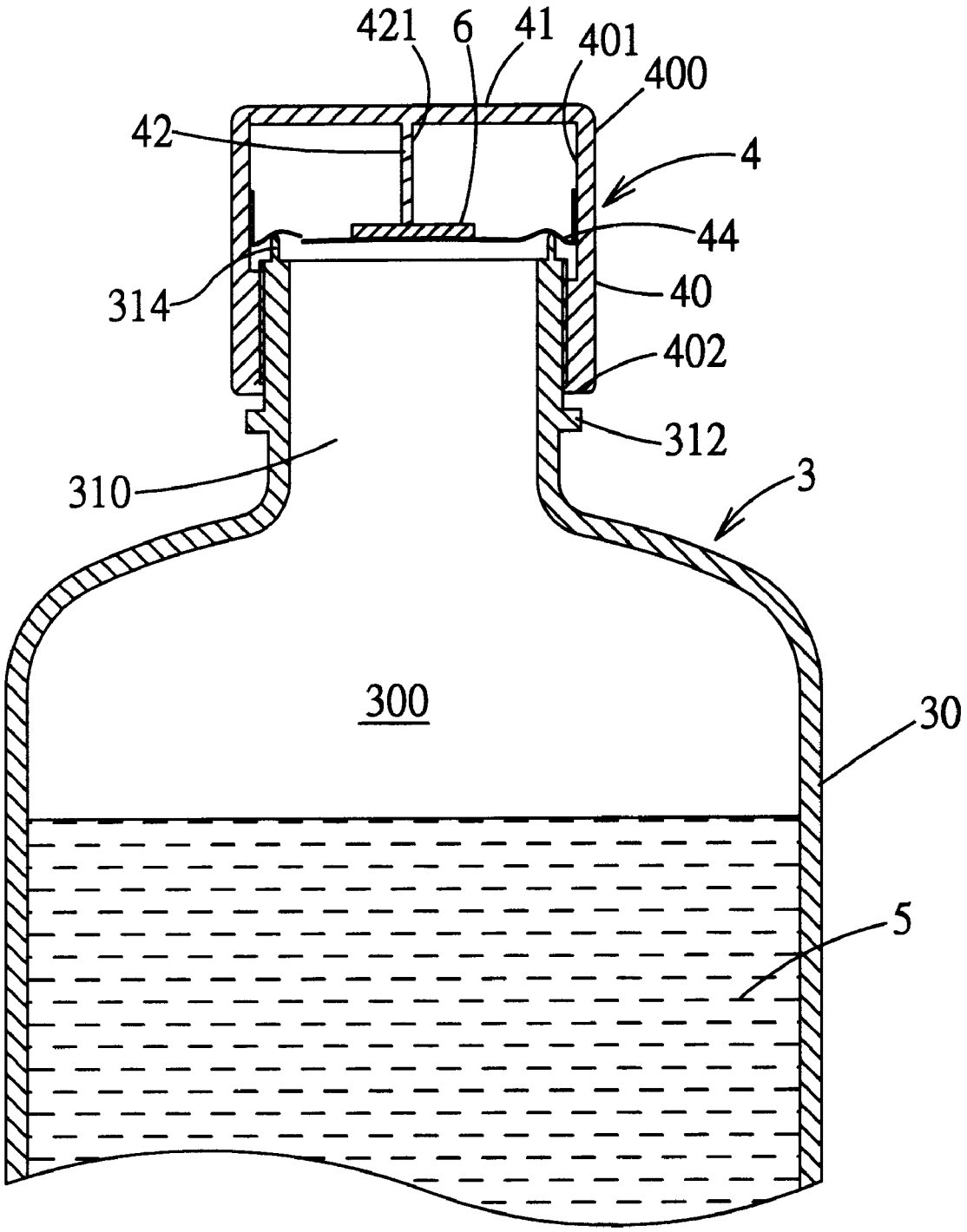
FIG. 3 is a schematic sectional view of the container device illustrated in FIG. 2 with its collar peeled off from the cap, followed by downwardly turning the cap clockwise by 90° to have the sealing film cut by the cutting means.
Figure 4:
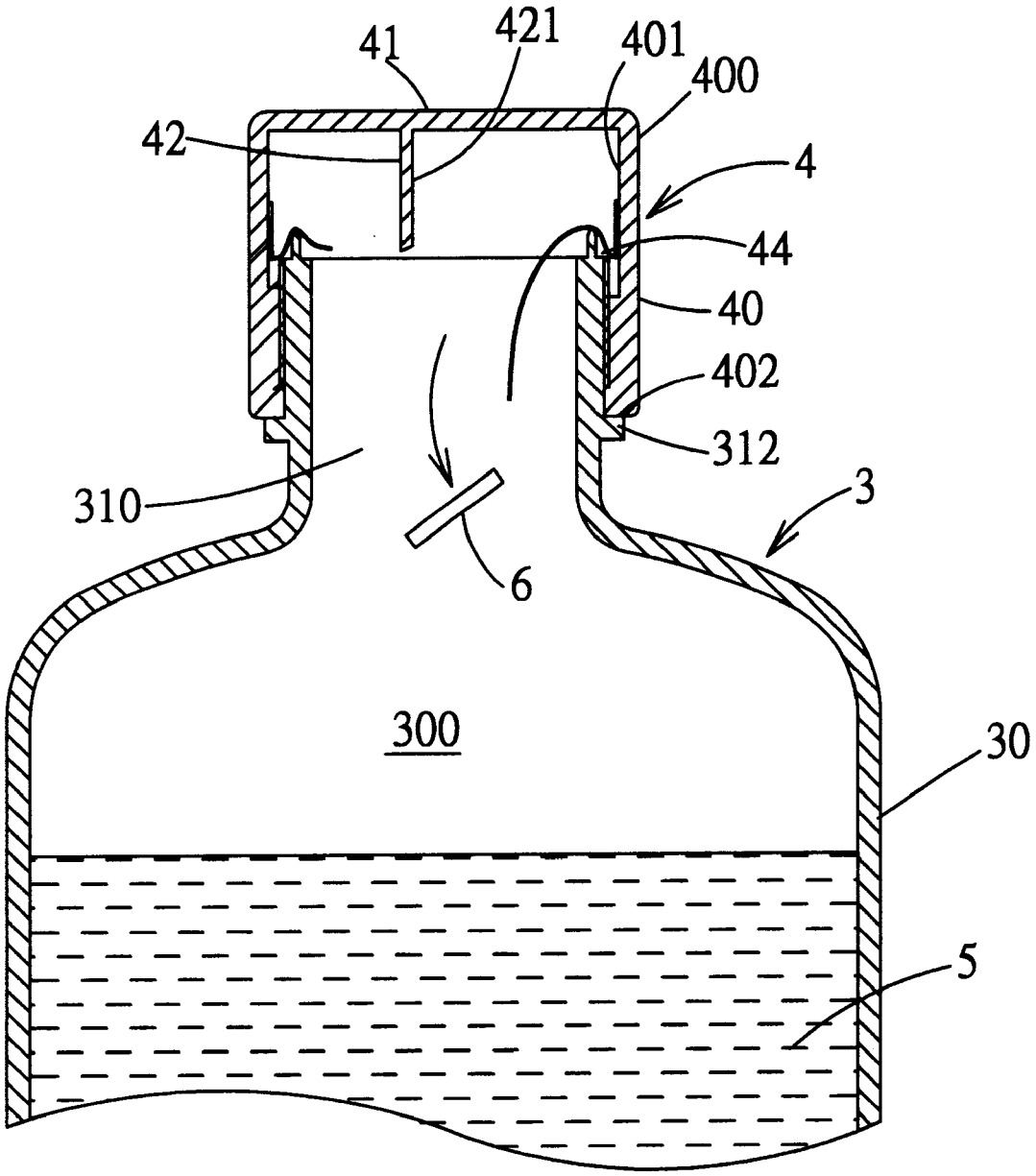
FIG. 4 is a schematic sectional view of the container device illustrated in FIG. 3 with the bottom of the cap abutting against the annular rib of the body.

The cutting member 42 is formed with a tip 420 on its end and with a cutting edge 421 along one of its sides. Therefore, as shown in FIG. 3, when the collar 45 is peeled off, the cap 4 is allowed to be turned downward, clockwise toward the annular rib 312. With the downward movement of the cap 4 the cutting member 42 will simultaneously descend to allow the tip 420 of the cutting member 42 to first penetrate the sealing film 44 and the cutting edge 421 of the cutting member 42 to then cut open the sealing film 44, as the convex portion of the sealing film 44 will remain in position due to the annular protrusion 314 of the neck 31. Proceeding with the clockwise turning of the cap 4, the sealing film 44 is able to be cut wide-open to allow the solute 6 to drop by its gravity from the air-tight room 46 to the storage space 300 of the body 3 via the opening 310, as shown in FIG. 4. As a result, the solute 6 can be solved in the liquid solvent 5 to become a drinkable solution for a person to consume.

The downward movement of the cap 4 ends at the time the lower surface 402 of the annular body 40 abuts against the annular rib 312 of the neck 31. It is the point that the cutting member 42 stops cutting open the sealing film 44. As the descending distance of the cap 4, which is corresponding to the thickness L of the collar 45, is set to limit the turning of the cap 4 to an extent of less than 360 degrees, the cutting member 42 is restrained from cutting off the sealing film 44 from the cap 4. Consequently, as shown in FIG. 4, the sealing film 44 is still partly attached to the inner surface 401 of the annular body 40 to thereby prevent the sealing film 44 from falling down to the storage space 300 of the body 3. When the solute 6 is well dissolved in the liquid solvent 5 to become a drinkable solution, the drinkable solution is ready to be consumed via the opening 310 of the neck 31 simply by upwardly turning the cap 4 counterclockwise to remove it from the neck 31 of the body 3.

Figure 5:
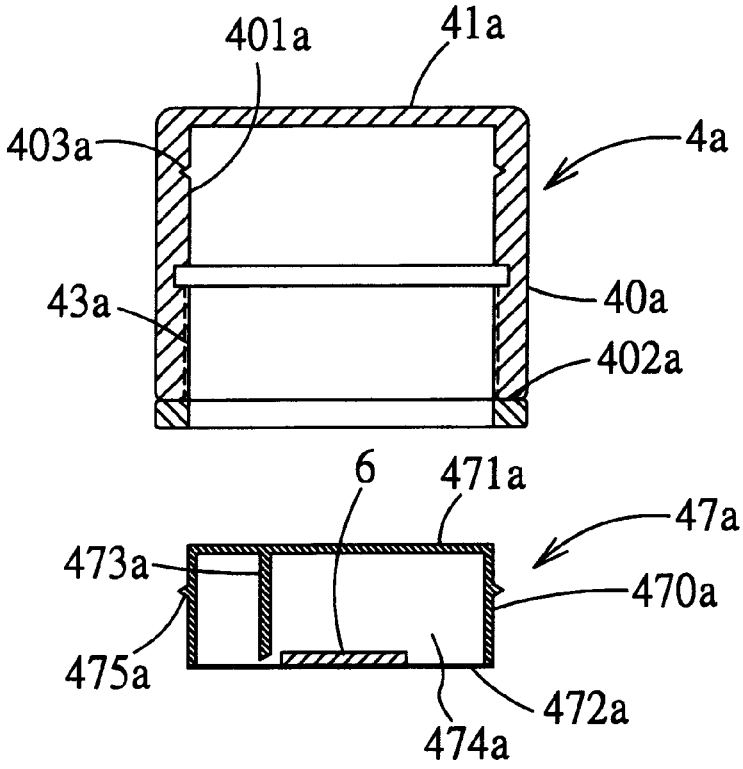
FIG. 5 is a schematic sectional view of a cap for use in the container device in accordance with the second embodiment of the present invention with its air-tight closure assembly separable from the cap.
Figure 6:
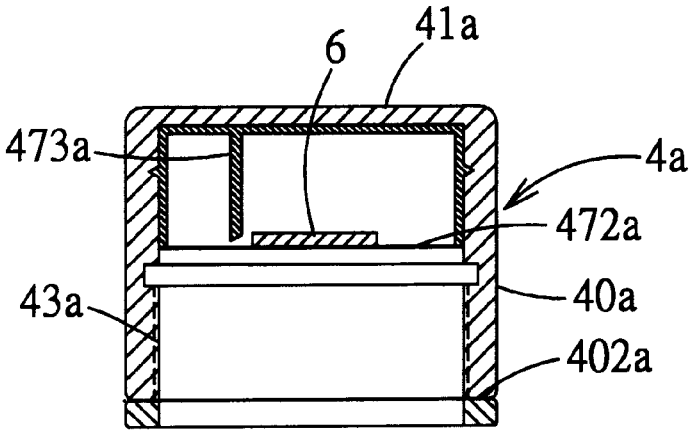
FIG. 6 is a schematic sectional view of the container device illustrated in FIG. 5 with its air-tight closure assembly installed within the cap.

FIGS. 5 and 6 are schematic sectional views of a cap for use in a container device according to the second embodiment of the present invention. The structure of the container device according to the second embodiment of the present invention is similar to that of the first embodiment of the present invention illustrated in the above, except for the structure of the cap. Accordingly, detailed description of the body is herein omitted for the purpose of simplification.

Referring now to FIG. 5, the cap 4*a* includes an annular body 40*a* having an inner surface 401*a* and a lower surface 402*a* and a lid 41*a* attached to the top of the annular body 40*a* for closing one end of the annular body 40*a*. The lower part of the inner surface 401*a* of the annular body 40*a* is threaded to form a second threaded portion 43*a* for engagement with a first threaded portion formed on the body (not shown) for mounting the threadable cap 4*a* to the body. Above the second threaded portion 43*a* an annular groove 403*a* is annularly formed on the upper part of the inner surface 401*a*. An air-tight closure assembly 47*a* is provided to be installed inside the cap 4*a*. The air-tight closure assembly 47*a* has an inner annular body 470*a*, an inner lid 471*a* attached to the top end of the inner annular body 470*a*, a sealing film 472*a* attached to the bottom end of the inner annular body 470*a*, and a cutting member 473*a* coupled to the bottom surface of the inner lid 471*a*. The inner lid 471*a*, the sealing film 472*a*, and the inner wall of the inner annular body 470*a*, in combination, form an air-tight room 474*a* for air-tightly encapsulating a solute 6 therein so as to keep the solute 6 from the ambient. On the outer wall of the inner annular body 470*a* there is also formed an annular engaging protrusion 475*a* for engagement with the groove 403*a* of the annular body 40*a* in order to securely couple the air-tight closure assembly 47*a* to the cap 4*a*, as shown in FIG. 6.

Figure 7:
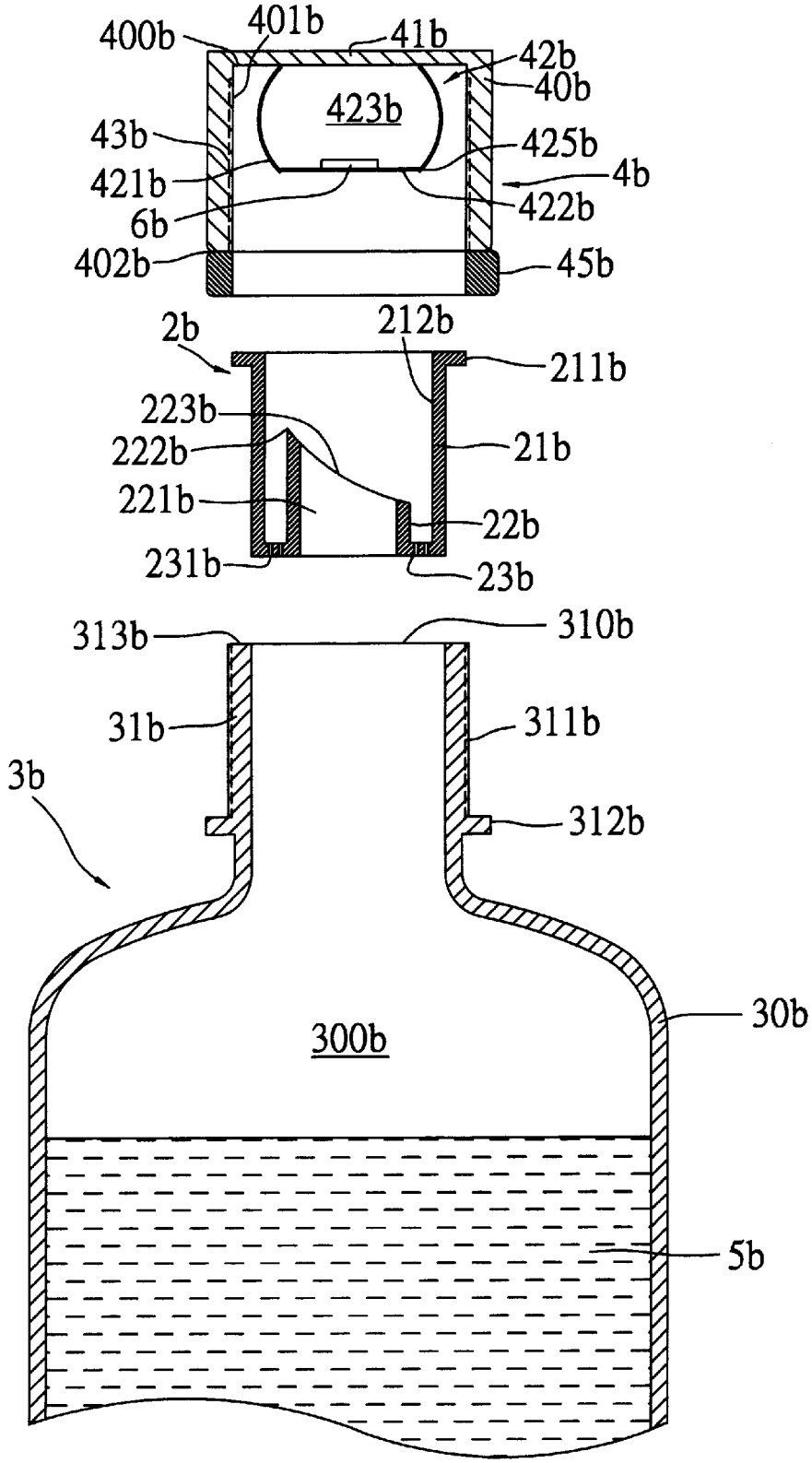
FIG. 7 is a schematic sectional view of a cap for use in the container device in accordance with the third embodiment of the present invention.
Figure 8:
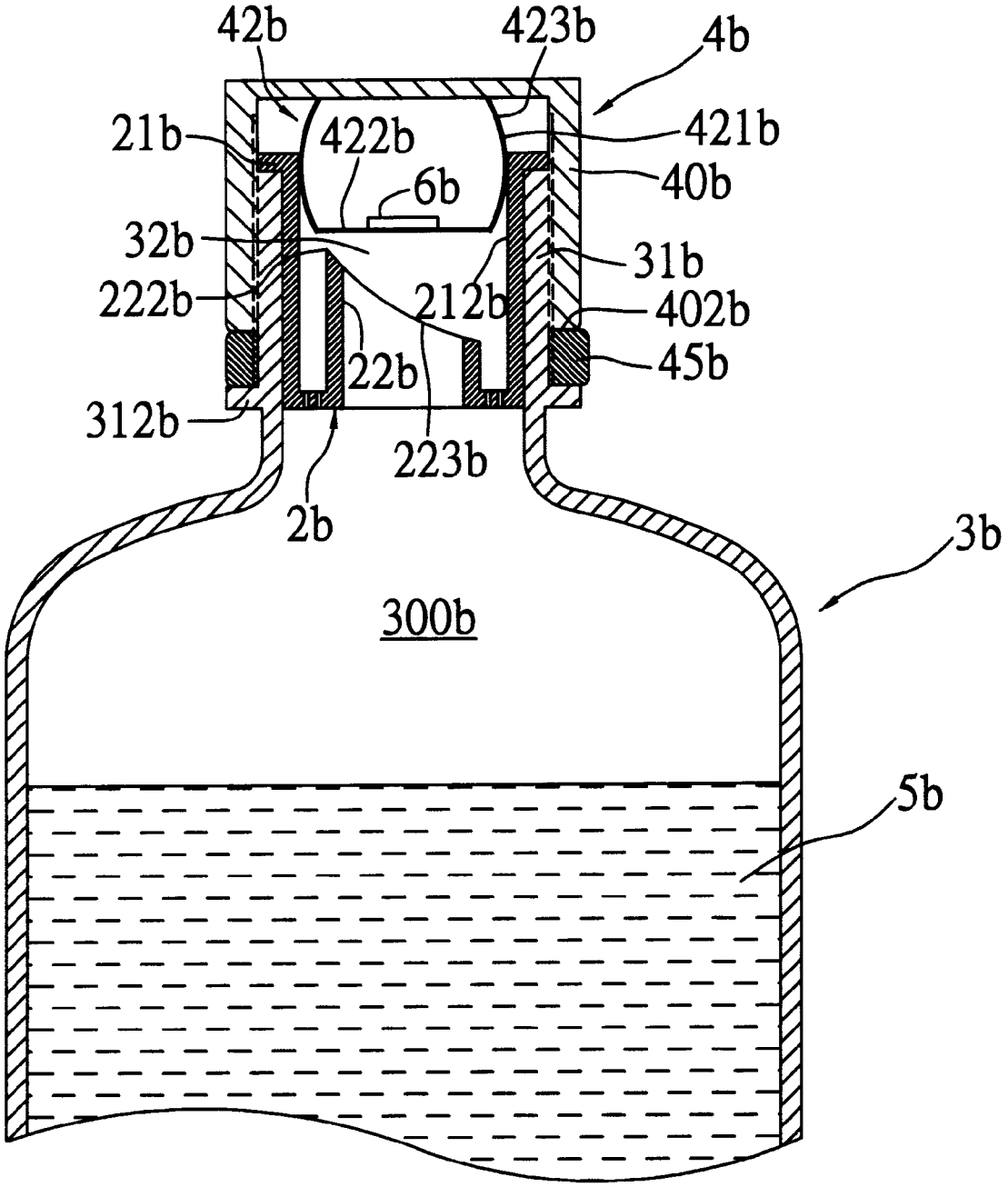
FIG. 8 is a schematic sectional view of the container device illustrated in FIG. 7 with its cap downwardly turned to a position that the bottom of the cap abuts against the annular rib of the body, after the collar of the cap is peeled off.

FIGS. 7 and 8 are schematic sectional views of the container device according to the third embodiment of the present invention.

The container device according to the third embodiment of the present invention includes a cutting structure 2*b*, a body 3*b* for receiving the cutting structure 2*b*, and a threadable cap 4*b* mounted to the body 3*b*.

The cutting structure 2*b* has an outer tubular body 21*b* and an inner tubular body 22*b* coaxially received within the outer tubular body 21*b* and formed with a passage 221*b*. On the top end of the outer tubular body 21*b* a flange 211*b* is integrally formed and extending outward. A bottom cover 23*b* is provided to respectively connect the bottom ends of outer tubular body 21*b* and inner tubular body 22*b* and is formed with a plurality of through holes 231*b* for fluid to pass therethrough. In order to provide a cutting function with the inner tubular body 22*b*, the inner tubular body 22*b* is formed with a tip 222*b* and has its peripheral edge 223*b* become sharpened.

The body 3*b* is integrally formed with a neck 31*b* on its top. The neck 31*b* has an upper surface 313*b*, a cylindrical outer surface threaded to form a first threaded portion 311*b*, and a cylindrical inner surface defining an opening 310*b* connecting a storage space 300*b* defined by an inner wall of the body 3*b* for receiving a liquid solvent 5*b*. In addition, an annular rib 312*b* is integrally formed on the outer surface of the neck 31*b* below the first threaded portion 311*b*. The cutting structure 2*b* is adapted to be received within the opening 310*b* of the neck 31*b* so that the flange 211*b* abuts the upper surface 313*b* to hold the cutting structure 2*b* in position and so that the opening 310*b* can be connected to the passage 221*b* of the cutting structure 2*b*.

The cap 4*b* includes an annular body 40*b* having an upper end 400*b*, an inner surface 401*b*, a lower end 402*b* opposing the upper end 400*b*, a lid 41*b* attached to the upper end 400*b* for closing one end of the annular body 40*b*, and an encapsulating structure 42*b* mounted to the bottom surface of the lid 41*b* for encapsulating a solute 6*b* therein. The encapsulating structure 42*b* is formed which has a resilient and outwardly curved annular body 421*b* with one end adhered by any conventional adhering method to the lid 41*b* and with another end sealed by a sealing film 422*b*. The annular body 421*b*, the sealing film 422*b* and the lid 41*b* together form an air-tight room 423*b* for encapsulating a solute 6*b* therein. The bottom end of the outwardly curved annular body 421*b* is diametrically greater than the inner tubular body 22*b* but is diametrically smaller than the outer tubular body 21*b*; however, the middle of the annular body 421*b* is of a diameter greater than the outer tubular body 21*b*. As a result, the annular body 421*b* of the encapsulating structure 42*b* is subject to an inwardly pressing force caused by the inner wall 212*b* of the outer tubular body 21*b*, allowing the annular body 421*b* to abut liquid-tight against the inner wall 212*b* of the outer tubular body 21*b* thereby preventing the liquid solvent 5*b* from leaking out of the body 3*b*. Between the lower end 402*b* of the annular body 40*b* and the annular rib 312*b*, a collar 45*b* is detachably attached when the threadable cap 4*b* is mounted to the body 3*b*. The collar 45*b* should have a thickness sufficient to refrain the tip 222*b* of the inner tubular body 22*b* from being in contact with the sealing film 422*b* of the encapsulating structure 42*b*. In the meantime, when the collar 45*b* is peeled off, the maximum descending distance of the cap 4*b*, which corresponds to the thickness of the collar, permits the sealing film 422*b* not to be cut off from the encapsulating structure 42*b*. In addition, the inner surface 401*b* of the annular body 40*b* is threaded to form a second threaded portion 43*b* for engagement with the first threaded portion 311*b* so as to securely mount the threadable cap 4*b* to the body 3*b*.

When the collar 45*b* is peeled off, the cap 4*b* is allowed to descend. With the downward movement of the cap 4*b* by a clockwise turning force, the sealing film 422*b* simultaneously descends to approach the tip of the inner tubular body 22*b* which remains still in position. Proceeding to downwardly turn the cap 4*b*, the tip 222*b* is allowed to first penetrate the sealing film 422*b*, followed by cutting open the sealing film 422*b* by the peripheral edge 223*b* of the inner tubular body 22*b*. At the time the sealing film 422*b* is cut wide-open enough to let the solute 6*b* to drop by gravity, the solute 6*b* can free-fall from the encapsulating structure 42*b* to the storage space 300*b* to be dissolved in the liquid solvent 5*b*. The downward movement of the cap 4*b* concludes until the lower surface 402 of the cap 4*b* abuts the annular rib 312*b* of the body 3*b*. As the cap 4*b* is downwardly turned to an extent of less than 360 degrees, the sealing film 422*b* is not completely cut off from the encapsulating structure 42*b* and is still partly attached to the annular body 421*b* so as to prevent the sealing film 422*b* from dropping down to the storage space 300*b*.

Figure 9:
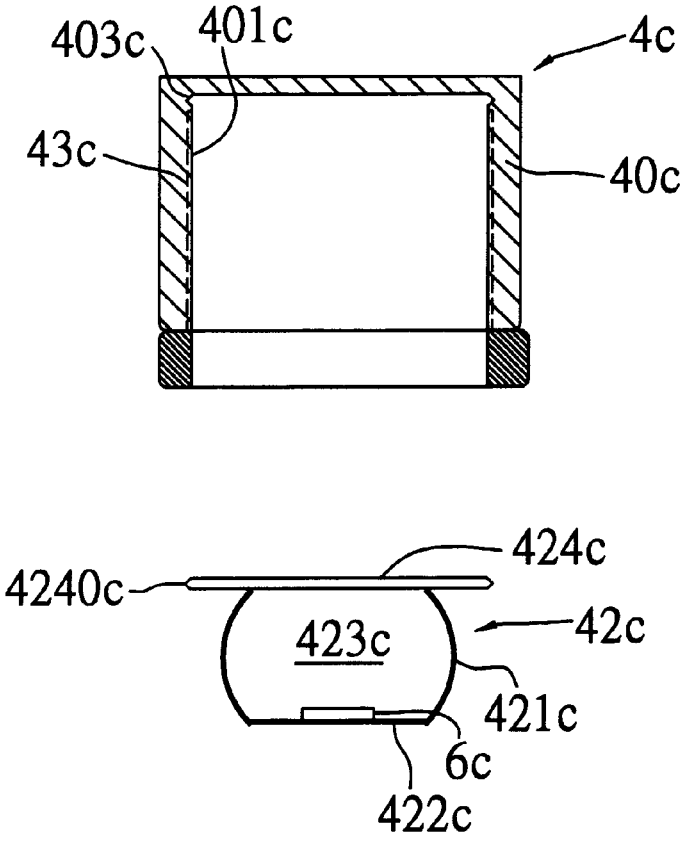
FIG. 9 is a schematic sectional view of a cap for use in the container device in accordance with the fourth embodiment of the present invention with its air-tight closure assembly separable from the cap.
Figure 10:
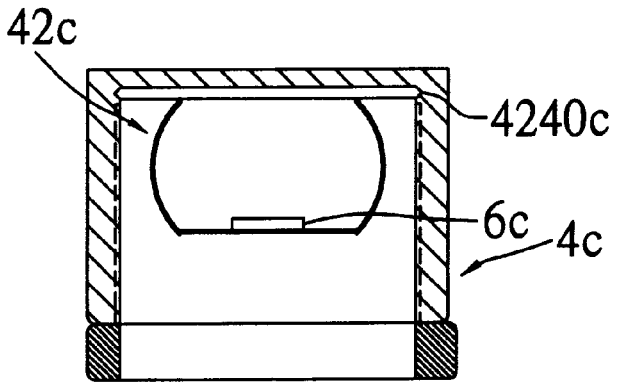
FIG. 10 is a schematic sectional view of the cap illustrated in FIG. 9 with its air-tight closure assembly installed within the cap.

FIGS. 9 and 10 are schematic sectional views of a cap for use in a container device according to the fourth embodiment of the present invention. The fourth embodiment is structurally similar to the third embodiment as described in the above, except for the structure of the cap. Accordingly, detailed description to the body is herein omitted for the purpose of simplification.

In the cap 4*c* of the fourth embodiment, a groove 403*c* is annularly formed on the inner surface 401*c* of the annular body 40*c* above the second threaded portion 43*c* in order to engage the peripheral rim 4240*c* of an inner lid 424*c* to cover the top end of the resilient and outwardly curved annular body 421*c* of the encapsulating structure 42*c*. An air-tight room 423*c* is thus formed by the annular body 421*c*, the inner lid 424*c* and the sealing film 422*c* for sealing the bottom end of the annular body 421*c*, and for an air-tight encapsulation of a solute 6*c*.

What is claimed is:

1. A container device, comprising:

a body having a neck integral with the top thereof, the neck being formed with an opening connecting a storage space defined by the body for receiving a first substance and being formed with an annular rib on an outer surface of the neck;

a cap member removably mounted to the neck of the body for closing the opening of the body;

an air-tight closure assembly received inside the cap member for an air-tight encapsulation of a second substance and being simultaneously movable with the cap member in an axial manner along the neck of the body, the air-tight closure assembly being cooperative with the neck of the body to seal liquid-tight the storage space of the body;

a cutting means coupled to the air-tight closure assembly for releasing the second substance from the air-tight closure assembly; and a collar detachably attached between a bottom of the cap member and the annular rib.

2. The container device of claim 1, wherein the cap member comprises an annular body and a lid covering one end of the annular body.

3. The container device of claim 2, wherein the air-tight closure assembly is formed by an inner surface of the annular body, a bottom surface of the lid, and a sealing film circumferentially attached to the inner surface of the annular body.

4. The container device of claim 3, wherein the sealing film is made of a flexible and extendible material.

5. The container device of claim 4, wherein the sealing film is made of aluminum alloy.

6. The container device of claim 1 or 3, wherein the neck of the body is further formed with at least an annular protrusion upwardly protruded from a top surface of the neck, allowing the annular protrusion to upwardly press against the sealing film of the air-tight closure assembly after the cap is mounted in position to the neck of the body, so as to seal air-tight the storage space of the body.

7. The container device of claim 1 or 3, wherein the collar is of a thickness that allows the cutting means to keep apart from the sealing film of the air-tight closure assembly after the cap member is securably mounted to the neck of the body by means of the collar.

8. The container device of claim 1 or 3, wherein the cap member can be downwardly turned to a maximum extent of less than 360 degrees, so as to restrain the sealing film from being cut off from the air-tight closure assembly by the cutting means.

9. The container device of claim 1, wherein the air-tight closure assembly comprises an inner annular body, an inner lid covering one end of the inner annular body, and a sealing film sealing the other end of the inner annular body.

10. A container device, comprising:

a body having a neck integral with the top thereof, the neck being formed with an opening connecting a storage space defined by the body for receiving a first substance and being formed with an annular rib on an outer surface of the neck;

a cap member removably mounted to the neck of the body for closing the opening of the body;

an air-tight closure assembly retained inside the cap member for an air-tight encapsulation of a second substance and being simultaneously moveable with the cap member in an axial manner along the neck of the body;

a cutting structure mounted inside the opening of the neck for releasing the solute from the air-tight closure assembly, the cutting structure having a passage connecting the opening of the neck for the first substance to pass therethrough and being cooperative with the air-tight closure assembly to seal air-tight the storage space of the body to prevent leakage; and a collar detachably attached between a bottom of the cap member and the annular rib.

11. The container device of claim 10, wherein the air-tight closure assembly is formed by a resilient, outwardly-curved annular body with one end attached to an inner top surface of the cap member and with another end sealed by a sealing film, allowing the solute to be encapsulated air-tight within the air-tight closure assembly.

12. The container device of claim 10, wherein the air-tight closure assembly is formed by a resilient, outwardly-curved annular body having an upper end and a lower end, an inner lid attached to the upper end, and a sealing film attached to the lower end.

13. The container device of claim 12, wherein the air-tight closure assembly is attached to the cap member by adhering the inner lid to an inner top surface of the cap member.

14. The container device of claim 10, wherein the cutting structure comprises an outer tubular body for holding the cutting structure in position in the opening of the neck and an inner tubular body coaxially received within and connected to the outer tubular body for releasing the solute from the air-tight closure assembly, allowing the air-tight closure assembly to axially move inside the outer tubular body in an air-tight manner with the movement of the cap member and to be cut open at the time the air-tight closure assembly is in contact with the inner tubular body.

15. The container device of claim 14, wherein the inner tubular body is formed with a tip and a cutting edge for releasing the second substance from the air-tight closure assembly.

16. The container device of claim 10, wherein the sealing film is made of a flexible and extendible material.

17. The container device of claim 16, wherein the sealing film is made of aluminum alloy.

18. The container device of claim 14, wherein the diameter of the outer tubular body is between a maximal diameter and a minimal diameter of the resilient, outwardly-curved annular body, and the diameter of the inner tubular body is smaller than the minimal diameter of the resilient, outwardly-curved annular body and can be inwardly pressed and deformed by the outer annular body, while the cap is mounted to the neck of the body, and the sealing film of the air-tight closure assembly can be cut open by the inner tubular body with the downward movement of the cap.

19. The container device of claim 14, wherein the collar is of a thickness that allows the inner tubular body of the cutting structure to keep apart from the sealing film of the air-tight closure assembly subsequent to the mounting of the cap member to the neck of the body.

20. The container device of claim 14, wherein the cap member can be downwardly turned to a maximal extent of less than 360 degrees, so as to prevent the sealing film from being completely cut off from the air-tight closure assembly by the inner tubular body of the cutting structure.

* * * * *